US005531358A

United States Patent [19]

Corella

[11] Patent Number: 5,531,358

[45] Date of Patent: Jul. 2, 1996

[54] FLEXIBLE DISPENSING PACKAGE

[76] Inventor: Arthur P. Corella, 8166 Vanscoy Ave., North Hollywood, Calif. 91602

[21] Appl. No.: 317,186

[22] Filed: Oct. 3, 1994

Related U.S. Application Data

[63] Continuation-in-part of Ser. No. 14,753, Nov. 1, 1993, Pat. No. Des. 354,221.

[51] Int. Cl.[6] ..... B65D 35/08

[52] U.S. Cl. ..... 222/107; 222/541.1

[58] Field of Search ..... 222/105, 107, 222/541.1, 541.2, 541.6, 541.9, 207

[56] References Cited

U.S. PATENT DOCUMENTS

| | | | |
|---|---|---|---|
| 2,707,581 | 5/1955 | Kaplan et al. | 222/107 |
| 4,232,721 | 11/1980 | Martin et al. | 222/107 X |
| 4,470,521 | 9/1984 | Scammell | 222/107 |
| 4,491,245 | 1/1985 | Jamison | 222/107 |
| 4,696,404 | 9/1987 | Corella | 383/200 |
| 4,890,744 | 1/1990 | Lane, Jr. et al. | 222/107 X |
| 4,935,283 | 6/1990 | Jamison | 222/107 X |
| 4,974,732 | 12/1990 | Sullivan et al. | 222/107 X |
| 4,988,016 | 1/1991 | Hawkins et al. | 222/107 X |
| 5,343,903 | 9/1994 | Winder | 141/363 X |

*Primary Examiner*—Kevin P. Shaver
*Attorney, Agent, or Firm*—Donald Diamond

[57] ABSTRACT

A package includes opposed flexible sides and a circumferential peripheral seal determining an interior sealed enclosure for storing a material, typically a viscous liquid. The package includes a depending seal which divides the enclosure into a storage reservoir and a dispensing channel in fluid communication. The dispensing channel includes an open upper end and a closed lower end, the upper end being in fluid communication with the storage reservoir, and the lower end being contiguous to the peripheral seal and to an aperture within the depending seal that is adapted to be torn open. Tearing the aperture results in collaterally tearing open the lower end of the dispensing channel and the contiguous portion of the peripheral seal, thereby enabling removal of package contents.

13 Claims, 2 Drawing Sheets

FLEXIBLE DISPENSING PACKAGE

CROSS-REFERENCE TO RELATED APPLICATION

This application is a continuation-in-part of U.S. Design patent application No. 29/014,753 filed Nov. 1, 1993 for Dispensing Package With Teardrop Finger Slot, now U.S. Design Pat. No. 354,221 dated Jan. 10, 1995.

BACKGROUND OF THE INVENTION

1. Field of the Invention

The invention relates to dispensing packages. More particularly the subject invention relates to a dispensing package having a storage reservoir and a dispensing channel to facilitate removal of the package's contents through a single opening created in the dispensing channel.

2. Description Of The Related Art

Today's lifestyle demands convenient, economical and size conscious packaging of materials that are used in everyday life. Availability of small convenient packages is especially relevant to the lifestyle of individuals who frequently travel. Small convenient packages simplify packing. Also, in the event an individual has forgotten certain necessary items, they can be inexpensively provided in hotel rooms. Small packages of liquid soap, shampoo, conditioner, and other viscous fluid materials have been widely manufactured, but are consistently difficult to open and typically are used only a single time. That is, either all contents are removed once a package is opened, or the partially filled package is discarded because, once opened, it becomes too messy to be handled conveniently.

In addition to offering convenience, flexible single-use packages have attributes which are becoming increasingly important in today's environmentally conscious world. Specifically, they require substantially less fabrication material than bottles, and can be manufactured from biodegradable materials.

The packaging of liquid products in heat sealable dispensing enclosures by high-speed production techniques; and equipment is a well-developed art. Heat sealed, packaged products are generally referred to as having a "form-filled" sealed construction, and are sometimes characterized as "form-and-fill" packages. Such packages can be fabricated in a wide variety of shapes and configurations. For example, three basic pouch configuration types are known as pillow type, three-sided seal type, and four-sided seal type. Pillow type packages are constructed from a single sheet, and are provided with a top and a bottom seal along a vertical seam which can take the form of a thin seal or a lap seal. Three-sided seal type packages are usually formed from a single sheet and include a a top seal, two opposed side seals, and a bottom fold. Four-sided seal type packages are constructed from one or two sheets and include a top seal, a bottom seal, and two opposed side seals.

Single-layer sheets or multi-layer laminate sheets can be used in fabricating heat sealable packages. In either form, oppositely disposed sealable faces generally are comprised of heat sealable thermoplastic materials such as polyethylene or polypropylene. Where laminates are used, the inner layer may be polyethylene, while the outer layer may be cellophane, paper, polyester, metallized polyester, aluminum foil or the like. Heat sealable laminates comprising three or more layers are sometimes referred to as having a "sandwich" structure or configuration.

Use of moderately thick thermoplastic films as heat sealable packaging materials, as well as use of materials such as linear low density polyethylene and high strength polyester in fabricating heat sealable laminates, have resulted in packages with excellent sealing and barrier resistance properties. However, use of these materials often results in packages that are extremely difficult to open. The problem is aggravated when an individual's hands, and particularly, the fingers, are wet or oily. Previously, this problem has been addressed by providing a "starter tear" cut in a peripheral seal of a package. For example, a slot or notch is provided in a peripheral seal to act as a guidance means for tearing open a heat-sealed package. Because starter tear cuts are produced by a hot knife or blade, a resulting slot or notch has a tendency to reseal itself. Moreover, the utility of a starter tear cut depends on the cut depth which is limited by the width of the peripheral seal. Also, starter tear cuts do not substantially alleviate problems associated with opening tear-resistant packages when an individual's fingers are wet or oily.

My prior patent, U.S. Pat. No. 4,696,404 ("404"), is directed to the problem of opening tear-resistant packages, particularly when fingers are wet or oily. The invention provides for a peripherally sealed dispensing package and an inner seal disposed within a central portion of the package. The inner seal includes an aperture extending therethrough which may be used to tear the package open for removal of its contents. The aperture assists in opening the package so that the contents from the main body of the package may be dispensed through two openings created along a sealed edge of the package. However, the "404" patent does not address the problem of providing a package which can be easily opened under such conditions, and which then allows a measured quantity of its contents to be dispensed more than once.

Thus, there remains a need for a reliable, inexpensive, and environmentally compatible package which is not limited to a single usage but which can repetitively dispense a measured quantity of a material contained within the package.

OBJECTS OF THE INVENTION

Accordingly, it is an object of the present invention to provide a package for simple, convenient and inexpensive packaging of viscous liquid materials.

Another object of the invention is to provide a package that is easily torn open to produce a single opening at a predetermined location for dispensing package contents.

A further object of the invention is to provide a package having a storage reservoir in fluid communication with a separate and distinct dispensing channel.

Yet another object of the invention is to provide a package capable of repetitively dispensing a measured quantity of fluid in a convenient and reliable manner.

A further object of the invention is to provide a device which is biodegradable and otherwise environmentally compatible.

A still further object of the invention is to provide a device that is simple, reliable and easy to use.

One more object of the invention is to provide a device that is simple and inexpensive to manufacture.

Other objects of the invention will become evident when the following description is considered with the accompanying drawings.

SUMMARY OF THE INVENTION

These and other objects of the invention are achieved by providing a package including opposed flexible sides and a circumferential peripheral seal determining an interior sealed enclosure for storing a material, typically a viscous liquid. The package includes a generally vertically depending seal which divides the enclosure bilaterally into a storage reservoir and a dispensing channel. The dispensing channel includes an open upper end and a closed lower end, wherein the upper end is in fluid communication with the storage reservoir, and the lower end is contiguous to an aperture within the depending seal that is adapted to be torn open, thereby collaterally tearing open the lower end of the dispensing channel and a contiguous portion of the peripheral seal, so as to enable removal of package contents.

In use, the package is hung so that the aperture is located near the bottom of the package. By squeezing the opposed flexible sides, material is forced from the storage reservoir into the dispensing channel until the dispensing channel is filled with a measured quantity of material. Force is then applied to the aperture in a downward direction, tearing the aperture and thereby collaterally tearing open the dispensing channel lower end and contiguous portion of the peripheral seal. By squeezing on the opposed flexible sides of the dispensing channel, material is forced from the open lower end of the dispensing channel and out of the package. Should an additional quantity of material be required, material is pushed from the storage reservoir until the dispensing channel is again filled, and the material is then forced out of the dispensing channel in the manner described above.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENTS

Figure 1:
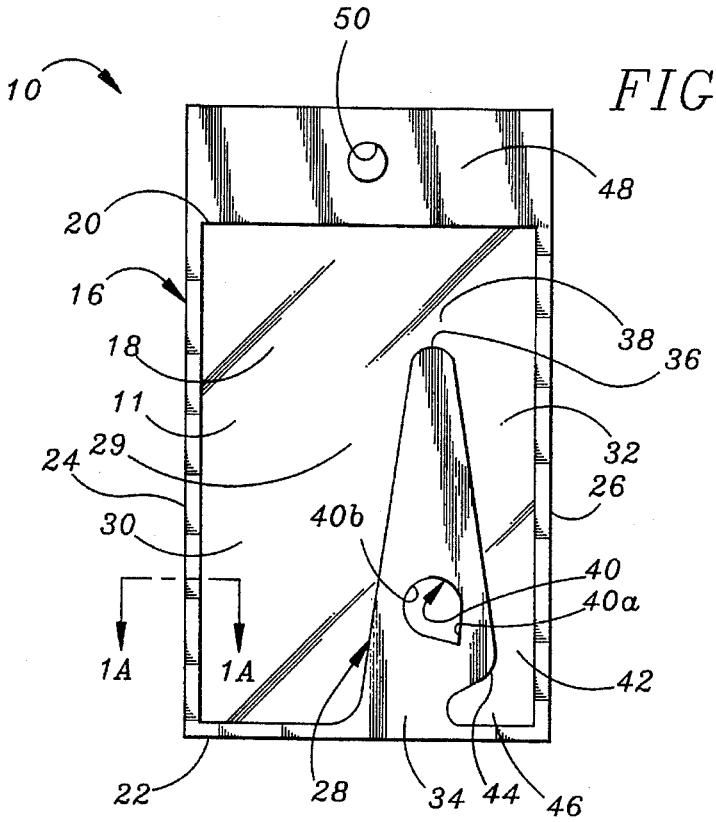
FIG. 1 is a front elevational view of a first preferred embodiment of a flexible dispensing package according to the present invention.

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

The invention relates to an article of manufacture which is primarily intended for storing and dispensing commonly used viscous fluid materials such as shampoo, conditioner and body lotion. However, the invention is not limited to particular types of material to be stored and dispensed, and can be used for storing and dispensing any material that can be placed within a subject package, although highly viscous fluids such as shampoos, soaps and conditioners are preferred.

Figure 1A:
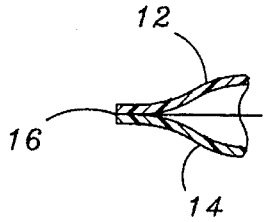
FIG. 1A is an enlarged, partial cross-sectional view taken along the line 1*a*–1*a* of FIG. 1.

Referring to FIGS. 1 and 1A, a first embodiment of a package 10 for storing and releasing shampoo, conditioner, or any similar material 11 is shown. The package is composed of two facing plastic sheets 12, 14, which are bonded together to form a circumferential peripheral seal 16 defining a sealed enclosure 18 between the two sheets. The peripheral seal 16 includes a sealed top edge 20, a sealed bottom edge 22, and opposed first and second sealed side edges 24, 26. The top edge 20, bottom edge 22, and side edges 24, 26 define a generally rectangular shape, although the package 10 can be configured to incorporate virtually any shape.

In the FIG. 1 embodiment, the sealed bottom edge 22 is connected to a depending seal (or weir) 28 which extends through a central portion 29 of sealed enclosure 18. Depending seal 28 separates the sealed enclosure into a storage reservoir 30 and a dispensing channel 32. Depending seal 28, formed by bonding together the two sheets 12 and 14, has a proximal end portion 34 contiguous with the sealed bottom edge 22, and a distal end portion 36 that termimates in spaced proximity to sealed top edge 20. Thus, the reservoir 30 and dispensing channel 32 are in fluid communication at a confluence 38 of the reservoir and channel.

A directional tear aperture 40 is disposed within depending seal 28 at a position adjacent to a bottom end portion 42 of the dispensing channel 32. Aperture 40 preferably is teardrop shaped, although any shape capable of focusing the direction of tearing will function within the spirit of the invention. Aperture 40 includes a substantially pointed portion 40*a* at one end of a longitudinal axis of symmetry, and a rounded portion 40*b* at an opposite end of the axis. As a result, when a user inserts a finger or other object within aperture 40 and pulls with sufficient force in the direction of pointed portion 40*a*, a tear will propagate beyond portion 40*a* in a direction approximately along a continuation of the longitudinal axis of symmetry of aperture 40. Consequently, the user will also tear through a portion 44 of depending seal 28 disposed between portion 40*a* and bottom end portion 42, and through a portion of sealed bottom edge 22 of peripheral seal 16, thereby opening bottom end portion 42 of dispensing channel 32 so that contents of the package can be removed.

As shown in FIG. 1, to facilitate convenient opening of dispensing channel 32, bottom end portion 42 may be appropriately curved to create a transverse channel 46. As a result, bottom end portion 42 and bottom edge 22 will be torn open in a region generally transverse to the generally vertical direction of dispensing channel 32.

As will be discussed subsequently, the package 10 is preferably hung when aperture 40 and thereby dispensing channel 32 are torn open. To facilitate opening the package with only one hand, the package is provided with a generally rectangularly shaped extension 48 of sealed top edge 20 which includes a hole 50 from which the package may be hung. Extension 48 is conveniently formed by thermally fusing continuations of sheets 12 and 14.

With regard to materials used for package 10, the package preferably is made from a biodegradable material, and preferably is manufactured from a laminate having, for example, a cellophane outer surface. Single-layer sheets or multi-layer laminate sheets can also be used in constructing the package. Where single-layer sheets or multi-layer laminate sheets are used, oppositely disposed sealable faces are generally comprised of heat sealable thermoplastic materials such as polyethylene or polypropylene. Where laminates are used, the inner layer may be polyethylene, while the outer layer can be cellophane, paper, polyester, metallized polyester, aluminum foil or the like. Heat sealable laminates comprising three or more layers, i.e., laminates having a sandwich construction or configuration, can also be used. Selection of a sheet or laminate, and the thickness thereof, are determined by the nature of the material being packaged.

In the first preferred embodiment, package 10 is comprised of opposed and superimposed sheets 12, 14. However, the package could be formed from a single sheet circumscribed in a manner to provide a pillow-type configuration.

Figure 2:
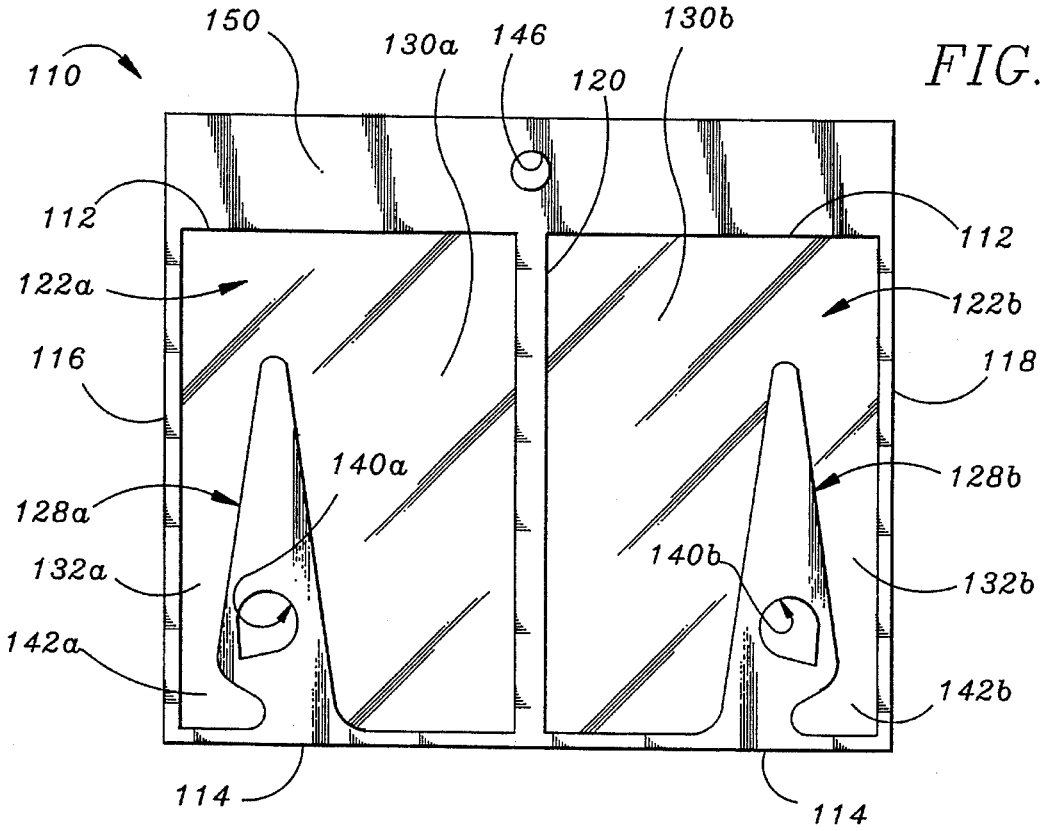
FIG. 2 is a front elevational view of a second preferred embodiment of a flexible dispensing package.

Referring to FIG. 2, a package 110 representative of a second, dual enclosure embodiment includes a common sealed top edge 112, a common sealed bottom edge 114, first and second sealed side edges 116, 118, and a common central sealed edge 120. Edge 120 divides the package 110 into separate first and second sealed enclosures 122*a*, 122*b*. Enclosures 122*a*, 122*b* include, respectively, a centrally depending seal 128*a*, 128*b* extending from the sealed bottom edge 114, which divides the enclosure into a storage reservoir 130*a*, 130*b*, respectively, and a dispensing channel 132*a*, 132*b*, respectively, that are in fluid communication. Additionally, each depending seal includes, respectively, a directional tear aperture 140*a*, 140*b* adjacent, respectively, to bottom end 142*a*, 142*b* of dispensing channel 132*a*, 132*b*.

Figure 3:
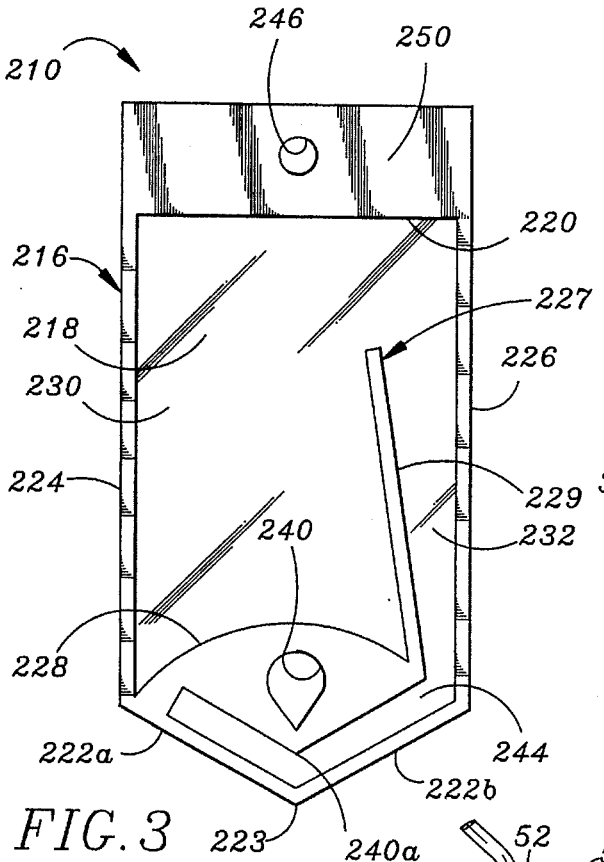
FIG. 3 is a front elevational view of a third preferred embodiment of a flexible dispensing package.

Referring to FIG. 3, a five-sided package 210 representative of a third embodiment includes a circumferential peripheral seal 216 defining a sealed enclosure 218. Peripheral seal 216 includes a first sealed bottom edge 222*a*, a second sealed bottom edge 222*b*, a sealed top edge 220, and opposed first and second sealed side edges 224, 226. Bottom sealed edges 222*a*, 222*b* meet to form a pointed bottom portion 223 of peripheral seal 216. A depending seal 227 includes a transverse portion 228 extending across the bottom portion of sealed enclosure 218, and a longitudinal portion 229 extending toward sealed top edge 220 of package 210. Depending seal 227 divides the sealed enclosure 218 into a storage reservoir 230 and a dispensing channel 232 which are in fluid communication. As a result of the shape of depending seal 227, the dispensing channel 232 includes a transverse channel 244 contiguous to the first and second sealed bottom edges 222*a*, 222*b*.

A teardrop shaped tear aperture 240 including a downward pointing pointed portion 240*a* is disposed within the transverse portion 228 of depending seal 227, the pointed portion 240*a* being directed toward the pointed bottom portion 223 of peripheral seal 216. Consequently, when aperture 240 is torn by applying a downward force, the transverse channel 244 is torn open substantially at its midpoint, thus opening dispensing channel 232 to enable removal of package contents.

As for the FIG. 1 embodiment, the FIGS. 2 and 3 embodiments include, respectively, a hole 146, 246 disposed within an extension 150, 250 of sealed top edge 112, 220, enabling a user to conveniently hang the package.

Figure 4A:
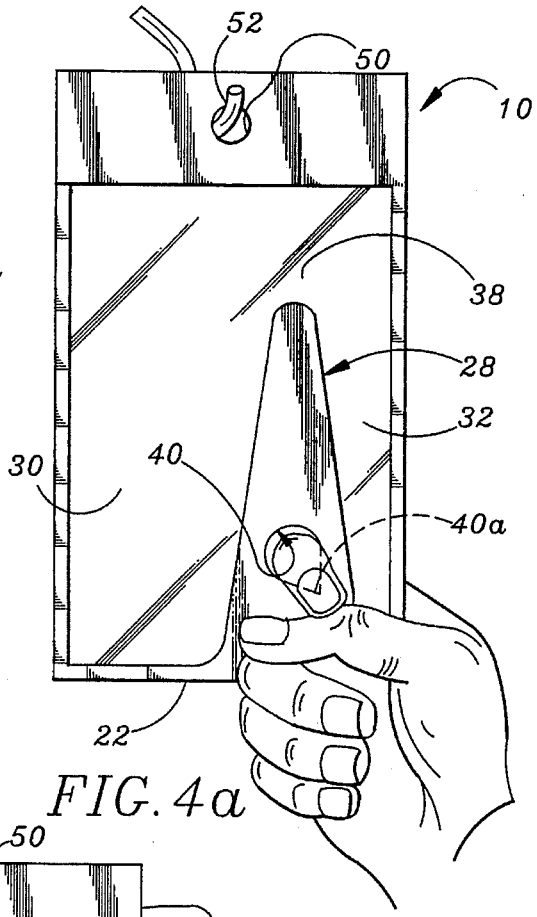
FIGS. 4A and 4B are sequential front elevational views showing usage of the FIG. 1 package, the usage being typical for the several embodiments.
Figure 4B:
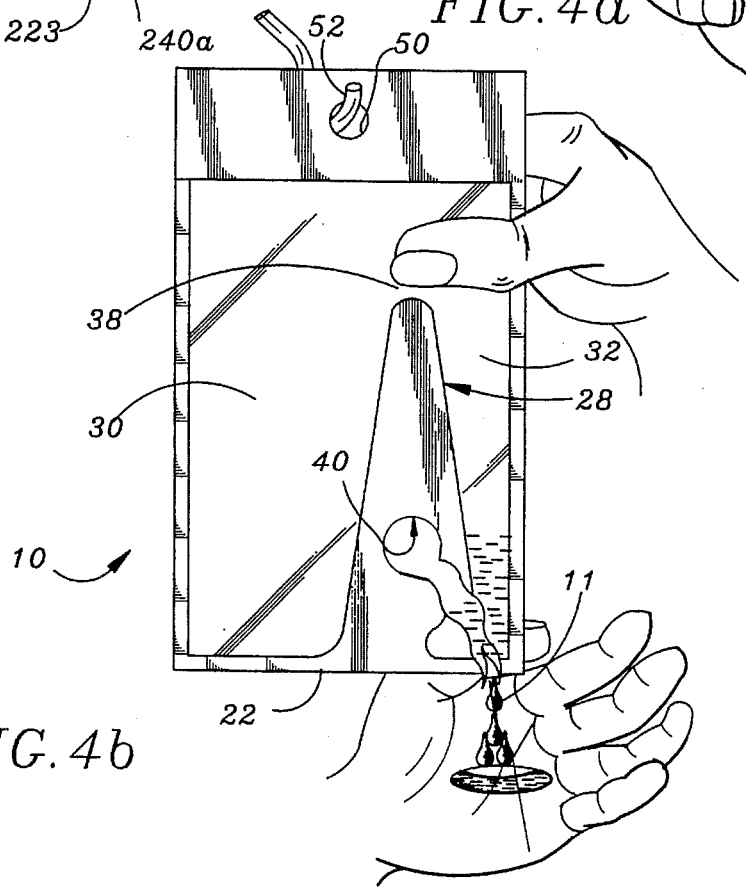

As shown in FIGS. 4A and 4B, in use the package 10 is hung from hole 50 by an appropriate device 52, e.g., a hook. The material 11 is then forced from storage reservoir 30 until dispensing channel 32 is filled with the material. A user then inserts a finger or other object within directional tear aperture 40 and pulls toward pointed portion 40*a* until sufficient force is applied to tear through, in sequence, depending seal 28, dispensing channel 32 and bottom edge 22 of peripheral seal 16. Once the dispensing channel 32 is opened, the user, by squeezing with thumb and forefinger, forces the material 11 within dispensing channel 32 downward and out of the package 10.

A user requiring additional material from the package simply pushes material from storage reservoir 30 upward toward the confluence 38 until dispensing channel 32 is refilled. The user then forces material from dispensing channel 32 in the manner described above. Thus, the user can obtain measured quantities of the package contents in an inexpensive, convenient and reliable manner.

The tear-open structure described herein can be incorporated into heat sealed packages of diverse configuration and construction, e.g., four-sided sealed packages, three-sided sealed packages, and pillow-type packages.

Since packages containing viscous material such as liquid soap and body use preparations are frequently opened under conditions where the hands are wet or oily, a directional tear aperture in the depending seal permits finger gripping a package to facilitate opening it. Additionally, the separate and distinct dispensing channel and storage reservoir provide a multi-use package allowing an individual to dispense, singly or repetitively, a measured quantity of the package contents.

The invention requires substantially less packaging material than do bottles, and may be manufactured from biodegradable materials. Additionally, the packages are water resistant, sanitary, disposable, and can be used to dispense a wide variety of materials.

What is claimed is:

1. A dispensing package comprising:

A sealed enclosure determined by superimposed first and second flexible sheets and a peripheral seal circumscribing the sheets, the seal comprising a top edge, a bottom edge, and opposed first and second side edges;

means for dividing the sealed enclosure into a storage reservoir and a dispensing channel, the dispensing channel including an open distal end portion in fluid communication with the storage reservoir, and an opposed closed proximal end portion contiguous to a section of the bottom edge of the peripheral seal, said dividing means comprises a depending seal comprising an upper portion, an opposed lower portion, and a central portion disposed between the upper and lower portions, the upper portion being in spaced proximity to the top edge of the peripheral seal, and the lower portion being contiguous to the bottom edge of the peripheral seal; and tear open means, responsive to force means, for tearing open the proximal end portion and peripheral seal section, said tear open means being disposed within the central portion of said depending seal and being defined by an aperture having a pointed portion and an opposed generally rounded portion.

2. The package of claim 1, wherein the pointed portion is oriented toward said proximal end portion and said peripheral seal section.

3. The package of claim 1, further comprising hanging means for hanging the package so that the bottom edge of the peripheral seal is downward.

4. The package of claim 3, wherein the hanging means comprises an extension of the top edge of the peripheral seal, the extension comprising continuations of the first and second sheets, the sheet continuations being fused together, and the extension including a hole.

5. The package of claim 1, further comprising a dispensable material disposed within the sealed enclosure.

6. The package of claim 5, wherein the material is selected from the group consisting of liquid soap, shampoo, hair conditioner and body lotion.

7. The package of claim 1, wherein the sheet are made of a polymeric material.

8. A method for preparing a multiuse, flexible, dispensing package which comprises:

forming a flexible enclosure circumscribed by a peripheral seal, except for an open portion for receiving viscous material;

forming within the enclosure a storage reservoir and a dispensing channel, the dispensing channel including an open portion in fluid communication with the storage reservoir and an opposed closed portion contiguous to a section of the peripheral seal, wherein the step of forming the storage reservoir and the dispensing channel comprises forming a depending seal in the enclosure, the depending seal comprising an upper portion, an opposed lower portion, and a central portion disposed between the upper and lower portions, the central portion having an aperture therein and the lower portion being contiguous to said peripheral section; and substantially filling the storage reservoir through said open portion with a viscous material and thereafter sealing said open portion;

said flexible package being manipulatable to move a quantity of viscous material from the storage reservoir to the dispensing channel and being tearable to open the closed portion of the dispensing channel and the contiguous section of the peripheral seal to thereby expel viscous material within the dispensing channel outwardly from the package through the torn opening under manipulating force applied to the dispensing channel.

9. The method of claim 8, wherein the aperture is formed with a pointed portion and a generally opposed rounded portion.

10. The method of claim 9, wherein the pointed portion of the aperture is oriented toward the opposed closed portion of the depending seal which is contiguous to a section of the peripheral seal.

11. A dispensing package comprising:

an enclosure determined by superimposed first and second flexible sheets and a peripheral seal circumscribing the sheets, the seal comprising a top edge, a bottom edge, and opposed first and second side edges;

a generally vertical depending seal dividing the enclosure into a storage reservoir and a dispensing channel, the dispensing channel comprising an open distal end portion in fluid communication with the storage reservoir, and an opposed closed proximal end portion contiguous to a section of the bottom edge of the peripheral seal, and the depending seal comprising an upper portion, an opposed lower portion, and a central portion disposed between the upper and lower portions, the upper portion being in spaced proximity to the top edge of the peripheral seal, the lower portion being contiguous to the bottom edge section of the peripheral seal, the central portion having an aperture disposed therein, the aperture having a pointed portion and an opposed generally rounded portion, the pointed portion being oriented toward said proximal end portion and said bottom edge section; and an extension of the top edge of the peripheral seal, the extension comprising continuations of the first and second sheets, the sheet continuations being fused together, and the extension including a hole.

12. A dispensing package comprising:

first and second juxtaposed enclosures determined respectively, by a first and second pair of superimposed flexible sheets, the first and second enclosures bounded by a common top sealed edge, a common bottom sealed edge, and a common interior sealed edge generally orthogonal to the top and bottom edges, the first and second enclosures further determined, respectively, by first and second side edges generally parallel to the common interior sealed edge;

a first and second generally vertical depending seal dividing, respectively, the first and second enclosures into a first and second storage reservoir and a first and second dispensing channel, the dispensing channels each comprising an open distal portion in fluid communication with the storage reservoir, and an opposed closed proximal end portion contiguous, respectively, to first and second sections of the bottom sealed edge, each depending seal comprising an upper portion, an opposed lower portion, and a central portion disposed between the upper and lower portions, each upper portion in spaced proximity to the top sealed edge, the first and second lower portions contiguous, respectively, to the first and second bottom edge sections, and the central portions each having an aperture disposed therein, each aperture having a pointed portion and an opposed generally rounded portion, each pointed portion oriented toward the corresponding proximal end portion and bottom edge section; and an extension of the top edge of the peripheral seal, the extension comprising continuations of the first and second pairs of sheets, the sheet continuations fused together, and the extension including a hole.

13. A dispensing package comprising:

an enclosure determined by superimposed first and second flexible sheets and a peripheral seal circumscribing the sheets, the seal comprising a top edge, opposed first and second side edges, and a lower edge including first and second sections joined at an acutely angled vertex;

a depending seal comprising a generally vertical portion and a transverse portion generally orthogonal to the vertical portion, the vertical portion dividing the enclosure into a storage reservoir and a dispensing channel, the dispensing channel comprising an open distal end in fluid communication with the storage reservoir, and a closed transverse portion contiguous to said lower edge, the transverse portion having an aperture disposed therein, the aperture having a pointed portion and an opposed generally rounded portion, the pointed portion oriented toward said vertex; and an extension of the top edge of the peripheral seal, the extension comprising continuations of the first and second sheet, the sheet continuations fused together, and the extension including a hole.

* * * * *